United States Patent [19]

Farina

[11] Patent Number: 4,537,403

[45] Date of Patent: Aug. 27, 1985

[54] GOLF CLUB

[76] Inventor: John Farina, 2228 W. Belmont, Chicago, Ill. 60618

[21] Appl. No.: 553,584

[22] Filed: Nov. 21, 1983

[51] Int. Cl.[3] ..... A63B 53/14

[52] U.S. Cl. ..... 273/164; 273/81.4; 273/168; 273/81 B

[58] Field of Search ..... 273/81 R, 81 B, 81 D, 273/81.3, 81.4, 80 R, 80 C, 67 A, 165, 167 R, 167 G, 167 J, 193 R; D21/210, 211, 214, 217, 218, 219, 220

[56] References Cited

U.S. PATENT DOCUMENTS

| | | | |
|---|---|---|---|
| D. 191,212 | 8/1961 | Hyde | D21/218 |
| 2,957,208 | 8/1957 | Gardner et al. | 273/67 A |
| 3,320,985 | 10/1965 | Maguire et al. | 273/81 R |

FOREIGN PATENT DOCUMENTS

| | | | |
|---|---|---|---|
| 926165 | 5/1963 | United Kingdom | 273/164 |

*Primary Examiner*—Richard C. Pinkham
*Assistant Examiner*—Vincent A. Mosconi
*Attorney, Agent, or Firm*—John J. Kowalik

[57] ABSTRACT

A golf club putter comprising a novel flat shaft having a width to be conveniently grasped by the user and having a head at its lower end with flat sides paralleling the flat sides of the shaft so that the club is adapted for left and right hand use and wherein a hand grip is provided at the upper end of the shaft with flat sides and having a series of finger-node indents spaced lengthwise of the shaft as guides for placement by the user of his fingers such that when a short putt is required the user places his lowest finger node on the lowermost indent and progressively places the lowest finger node into the next higher indents for longer putts.

3 Claims, 4 Drawing Figures

FIG. 3
FIG. 4
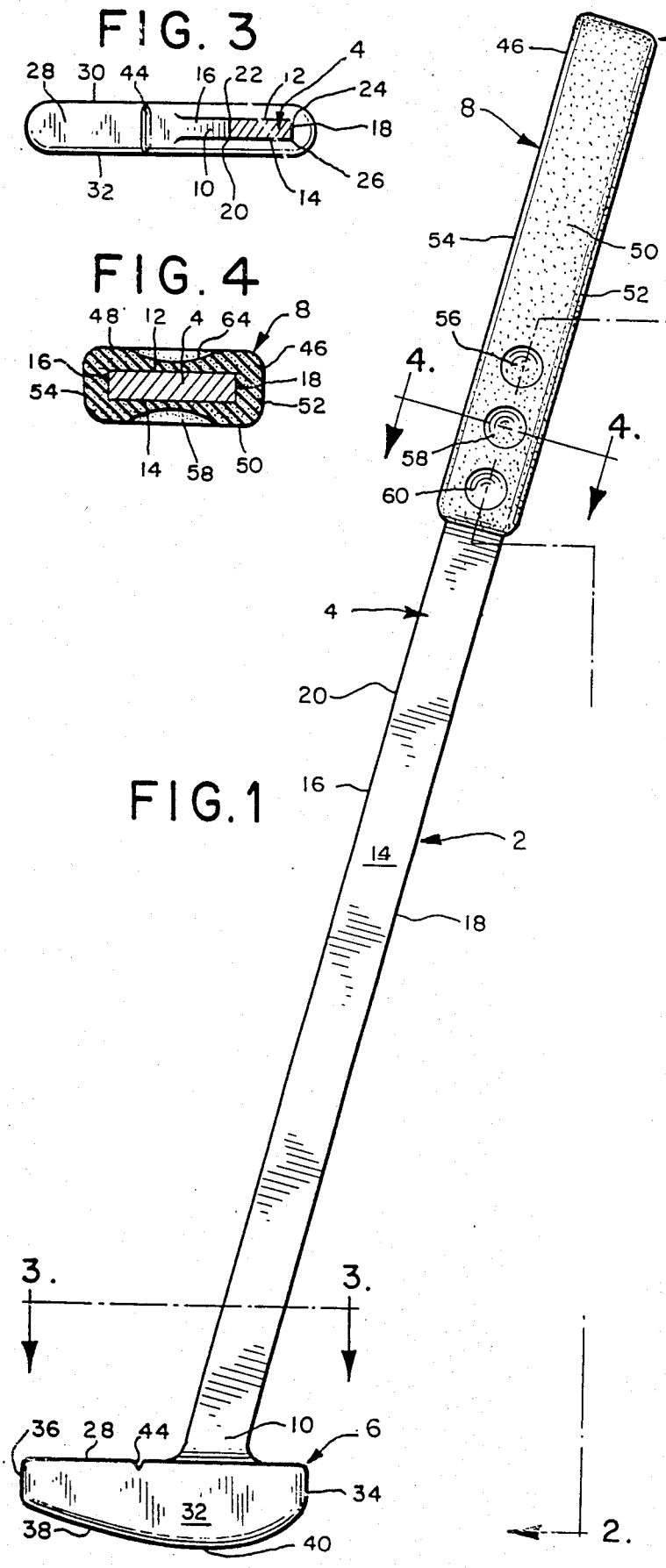
FIG. 1
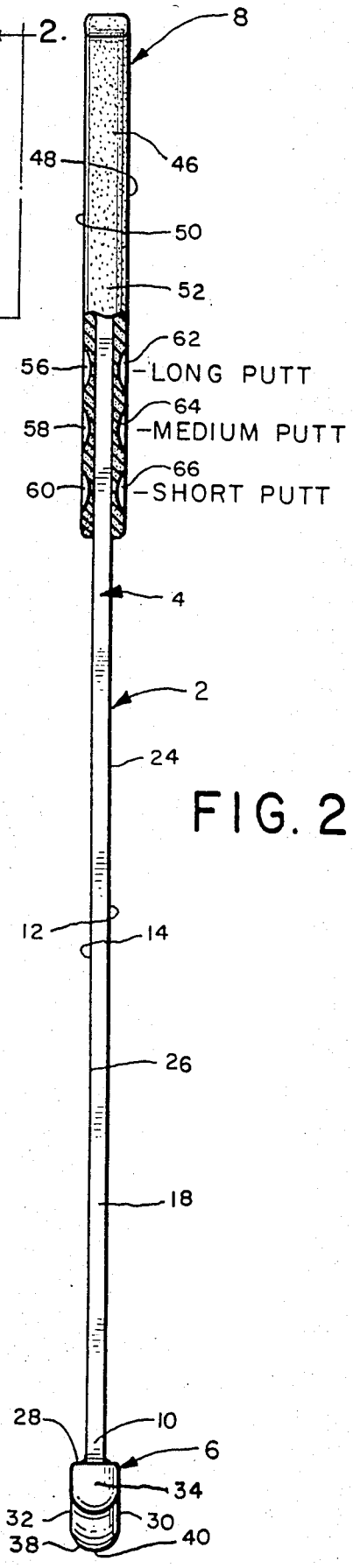
FIG. 2

GOLF CLUB

BACKGROUND OF THE INVENTION

This invention pertains to putters. In the past the use of s single flat side on a round or cylindrical handle was common. I have found that these types of grips are not satisfactory. The user's hand wraps about the curved portion and the fingers rest on the flat portion. Stability of the grasp is thus compromised. Also since the shaft is round and the head of the club is further differently configured, there is no accurate way for the user to get a clear line of sight along the club so as to properly position the ball striking face of the club with respect to the ball. The professional lines up the club with the ball through experience. However for most players this important part of the game is a hit and miss proposition.

SUMMARY OF THE INVENTION

This invention provides a novel combination of elements in a glof club which permits accurate alignment of the club and controls the grip on the club so that the ball is properly struck.

More specifically, the invention provides a novel flat shaft which is of a thickness and width sufficient to provide a comfortable grasp by the player at the handle end.

The invention comprehends a novel integration of the head shape as well as that of the shaft and handle portion in a putter such as will provide a novel more accurate club which is easy to use in a natural manner not only by the professional but also by the typical golfer.

A primary object of the invention is to provide a novel golf club which presents a relatively narrow outline crosswise of the shaft such as will provide unobstructed sighting of the club head along a narrow edge of the length of the shaft to the head and also provides a broad area along the sides of the shaft so that the player may easily gauge the position of the club head and dispose it at the proper attitude with respect to the ball.

In order to accomplish the foregoing objects, the invention comprehends a putter having a flat shaft, a flat handle and a flat head all extending in the same plane.

Another object is to provide a novel head for the flat shaft of the putter, the head being thicker than the shaft which is centered between opposite flat parallel sides of the head, and the head having a flat top and normal to the sides and merging therewith in sharp corners which are parralel to the opposite sides of the shaft, and the head having a toe and heel with blunt ends and a bottom edge which is arcuate transversely and lengthwise of the head and having its crest of curvature below and proximate the lower end of the shaft.

These and other object and advantages inherent in the invention and encompassed thereby will become more apparent from the specification and the drawings, wherein FIG. 1 is a side elevational view of the novel club;

FIG. 2 is a rear edge view thereof taken substantially on line 2—2 in section of FIG. 1;

FIG. 3 is a cross-sectional view taken substantially of line 3—3 of FIG. 1, and FIG. 4 is a cross-section taken substantially on line 4—4 of FIG. 1.

DESCRIPTION OF THE INVENTION

The accompanying drawings illustrate a putter, generally designated 2 having a shaft or shank 4, a head 6 at its lower end and a handle 8 at its upper end.

The club is made of metal, such as alloy aluminum or steel and the head is formed integral with the lower end of the shaft as shown at 10. The shaft is flat and is preferably one and one quarter inches wide and about one quarter inch thick, and presents flat lateral sides 12 and 14 and front and rear edges 16 and 18 which are arranged normal to the sides 12 and 14 and thus form unobstructed sighting corner 20, 22 along the front edge and sharp rear corners 24, 26.

The lower end of the shaft is blended into a flat top surface 28 of the head and the head is wider than the shaft to provide adequate mass so that upon hitting the ball, the club will not significantly rebound from the impact. The lateral sides 30 and 32 of the head are flat and parallel with the sides 12 and 14 of the shaft and are spaced laterally outwardly therefrom. The head extends aproximately two thirds of its length in front of the front edge of the shaft from the portion beneath the shaft and about a third of its length behind the shaft from said portion. The shaft is suitably angled to the top surface 28 of the head so that the handle, in upright position of the club, extends well behind the upright rear or heel edge 34 of the head as in any conventional club. The edge 34 is curved between the lateral sides of the head and presents a generally vertical profile in side elevation. The toe end of the club is similarly profiled to edge 34, so that the toe edge 36 and heel edge 34 are generally parallel. The bottom edge 38 of the head is of arcuate contour, being curved laterally and longitudinally of the head. The bottom edge is curved downwardly between the toe and heel and its crest of curvature, indicated at 40, is below the lower end of the shaft and offset rearwardly of the guide mark or line 44 formed in the top surface of the head normal to the sides thereof.

With this novel club, the player, upon grasping the handle and placing the head of the club against the ball, will instinctively sight the club to the ball to be struck by running his eyes along the front edge 16 of the shaft as delineated by the sharp corners 20 and 22 and will continue his line of sight unobstructedly to the guide line 44 and thence to the flat upright striking face of the head with which the player intends to hit the ball.

The handle is formed as a sleeve 46 made of elastomeric material such as rubber, either natural or synthetic, or plastic or fiber impregnated similar material. The sleeve is secured to the shaft by any suitable known adhesive and conforms generally to the shape of the shaft. The sleeve presents lateral flat sides 48,50 and edges 52,54 opposing sides 12 and 14 and edges 24 and 26 of the shaft, respectively.

Side 48 is provided with a series of finger indents 56,58 and 60 and side 50 with indents 62,64, and 66 spaced lengthwise of the shaft. The indents on one side of the shaft are transversely aligned with the respective indents on the opposite side of the shaft.

Since the club is both right and left hand, the player places the node of his forefinger in the uppermost indent 56 or 62 for a long putt, or within indent 56 or 64 for a medium length putt or in the lowermost indent 60 or 66 for a short putt.

The conformation of the handle gives the player a natural grasp and the flat sides prevent the club from turning in the hands when the ball is struck. Proper attitude of the head to the ball is maintained so that the ball will roll in the direction in which it is aimed.

I claim:

1. A putter golf club having a flat shank and a flat head at one end and a flat handle at the other end all located in a common plane, said shank having a straight sighting edge extending from the handle to the head, and said head having flat sides including a ball-striking face parallel with said sighting edge and offset laterally outwardly thereof, said handle having flat sides coplanar with the respective sides of the head.

2. The invention of claim 1, and said handle having a plurality of finger node indents spaced from each other lengthwise of the shaft for gauging short, medium and longs putts by the user placing his fingers therein accordingly.

3. A putter golf club having a shank and a head at one end and a flat handle at the other end all located in a common plane, and said head having ballstriking faces at opposite sides thereof and said handle having parallel sides coplanar with respective faces of the head, and stroke-gauging means formed in said sides of the handle comprising a series of indents spaced lengthwise of the handle and being concavely shaped.

* * * * *